United States Patent [19]

Holenstein

[11] Patent Number: 4,930,777

[45] Date of Patent: Jun. 5, 1990

[54] ELLIPSOIDAL-LIKE BALL

[76] Inventor: Robert J. Holenstein, R.D. 7, Box 659, Newton, N.J. 07860

[21] Appl. No.: 389,948

[22] Filed: Aug. 7, 1989

[51] Int. Cl.[5] ..... A63B 39/00

[52] U.S. Cl. ..... 273/65 EC; 273/65 EG; 273/65 ED; 273/DIG. 20; 446/74; 446/76

[58] Field of Search ..... 273/65 R, 65 E, 65 EC, 273/65 ED, 65 EG, 58 B, 58 BA, 58 H, 58 K; 446/73, 74, 76, 77

[56] References Cited

U.S. PATENT DOCUMENTS

| | | | |
|---|---|---|---|
| 405,999 | 6/1889 | Howard | 273/65 ED |
| 3,018,583 | 1/1962 | Novotney | 446/73 |
| 4,531,737 | 7/1985 | Jacobson et al. | 273/65 EC |

*Primary Examiner*—George J. Marlo
*Attorney, Agent, or Firm*—Alfred C. Hill

[57] ABSTRACT

An ellipsoidal-like ball comprises a capped, plastic beverage bottle emptied of its beverage; a pair of idential ellipsoid-like plastic end caps each disposed on a different end of the bottle; and a fastening arrangement interconnecting the pair of end caps to secure each of the pair of end caps to the bottle.

19 Claims, 2 Drawing Sheets

ELLIPSOIDAL-LIKE BALL

BACKGROUND OF THE INVENTION

The present invention relates to game balls and more particularly to an ellipsoidal game ball.

An ellipsoidal game ball is like a football employed in the U.S. game of football and is normally an inflated ball having a covering of leather or plastic and the like. The usual ellipsoidal ball is inflated by air from a pressure pump or the like.

SUMMARY OF THE INVENTION

An object of the present invention is to provide an ellipsoidal-like ball that does not require air inflation from a pump.

Another object of the present invention is to provide an ellipsoidal-like ball having as a major component thereof a plastic beverage bottle that has been emptied of its beverage and would normally be disposed in the waste stream.

A feature of the present invention is the provision of an ellipsoidal-like ball comprising a capped, plastic beverage bottle emptied of its beverage; a pair of identical partial elliposidal-like plastic end caps each disposed on a different end of the bottle; and a fastening means interconnecting the pair of end caps to secure each of the pair of end caps to the bottle.

Another feature of the present invention is the provision of a pair of identical end caps each engaging a different end of a capped plastic beverage bottle emptied of its beverage to form an elliposidal-like ball, each of the pair of end caps comprising a partial, ellipsoid-like shell having a longitudinal axis along the major axis of the partial ellipsoid; a plurality of rib-like members formed on the interior surface of the shell equally spaced about the longitudinal axis oriented to receive the neck of the bottle when engaged therewith; a first ridge-like abutment formed on each of the plurality of rib-like members in a transverse relation to the longitudinal axis adjacent the apex of the shell to abut the cap of the bottle; and a second ridge-like shell to abut the cap of the bottle; and a second ridge-like abutment formed on each of the plurality of rib-like members in a transverse relation to the longitudinal axis remote from the apex of the shell to abut the bottom of the bottle when engaged therewith.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENTS

Figure 1:
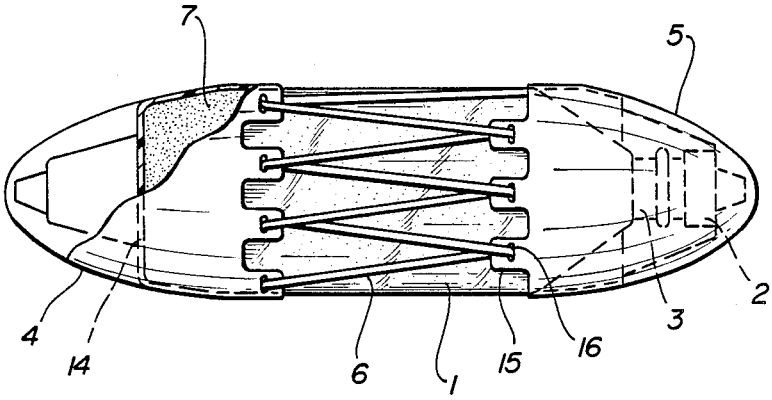
FIG. 1 is a plan view of the ellipsoidal-like ball in accordance with the principles of the present invention.

Referring to FIG. 1, the ellipsoidal-like ball in accordance with the principles of the present invention includes bottle 1 with its cap 2 still in place on the neck 3 of the bottle 1 so that plastic bottle 1 will be maintained in a substantially rigid condition. Identical end caps 4 and 5 are disposed on different ends of bottle 1. Identical end caps 4 and 5 are interconnected by a lace 6 to secure each of the pair of end caps 4 and 5 to bottle 1.

End caps 4 and 5 may be formed from thermal injected plastic and lace 6 may be a plastic lace or an elastic lace. If the weight of the formed ellipsoidal-like ball is not sufficient for the game being played, a ballast 7 may be placed inside bottle 1. This ballast may be either sand or water of sufficient quantity to provide the desired weight. Plastic bottle 1 may be a soda bottle of the two liter type. It should be recognized, however, that with an increase in size of end caps 4 and 5 bottle 1 could be a three liter type and with a decrease in the size of end caps 4 and 5 bottle 1 could be a bottle smaller than a two liter size.

The major components described hereinabove in FIG. 1 are the major components making up the ellipsoidal-like ball. The details of the identical pair of end caps 4 and 5 and one embodiment for enabling end caps 4 and 5 to be laced together will be described hereinbelow with respect to FIGS. 2 and 3.

Figure 2:
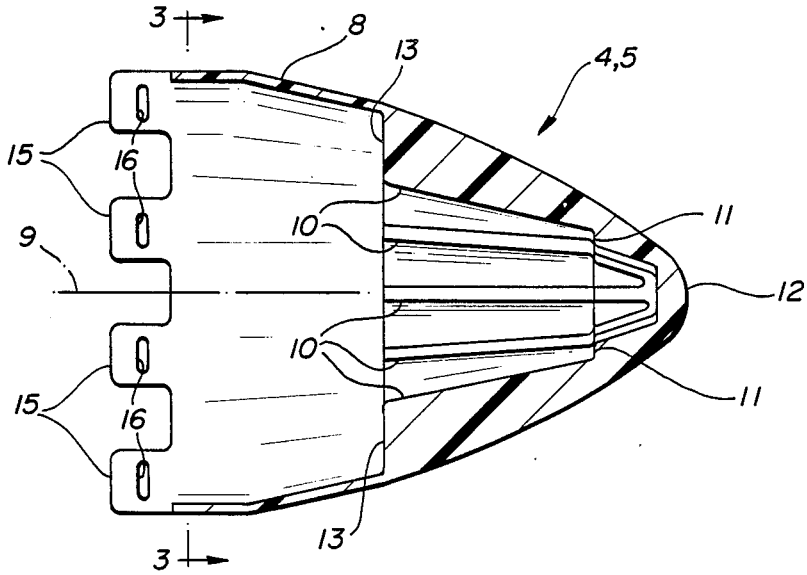
FIG. 2 is a cross-sectional view of one of the two identical end caps employed in the ellipsoidal-like ball of FIG. 1.
Figure 3:
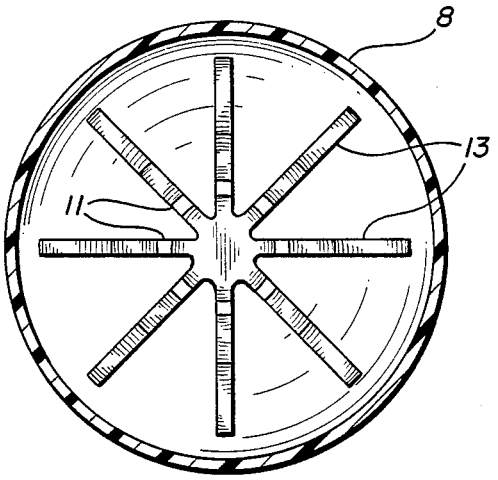
FIG. 3 is a cross-sectional view taken along line 3—3 of FIG. 2.

Referring to FIGS. 2 and 3, each of the pair of identical end caps 4 and 5 includes a partial, ellipsoidal-like shell 8 having a longitudinal axis 9 along the major axis of the partial ellipsoid. A plurality of rib-like members 10 are formed on the interior surface of shell 8 equally spaced about longitudinal axis 9 oriented to receive neck 3 of bottle 1 when the end cap engages neck 3 of bottle 1. A first ridge-like abutment 11 is formed on each of the members 10 in a transverse relation to longitudinal axis 9 adjacent apex 12 of shell 8 to abut cap 2 of bottle 1. A second ridge-like abutment 13 is formed on each of the members 10 in a transverse relation to longitudinal axis 9 remote from apex 12 to abut bottom 14 of bottle 1 when the end cap engages bottom 14 of bottle 1.

One embodiment of a fastening means cooperating with lace 6 is shown in FIGS. 1 and 2 and includes a plurality of tabs 15 spaced about the periphery of shell 8 adjacent second ridge-like abutments 13 with tabs 15 being substantially parallel to longitudinal axis 9. An eyelet 16 is provided in each of tabs 15 so that lace 6 may be threaded therethrough to hold end caps 4 and 5 securely on bottle 1.

Figure 4:
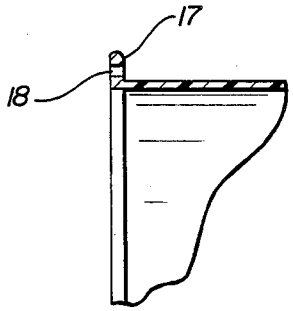
FIG. 4 is a partial cross-sectional view of an alternative arrangement for fastening the pair of end caps together on the bottle in accordance with the principles of the present invention.
Figure 5:
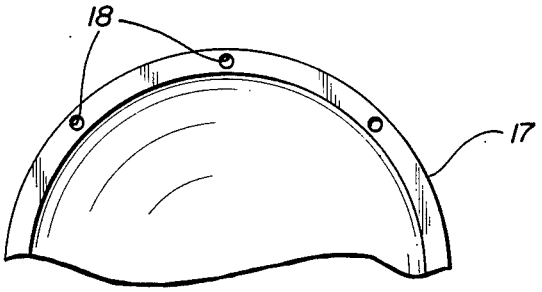
FIG. 5 is an end view of FIG. 4.

An alternative arrangement for fastening end caps 4 and 5 on bottle 1 in cooperation with lace 6 is shown in FIGS. 4 and 5. This alternative fastening arrangement includes a flange 17 extending outwardly from the periphery of shell 8 adjacent second ridge-like embodiments 13 in a transverse relation to longitudinal axis 9. A plurality of spaced eyelets 18 are disposed in flange 17 through which lace 6 is threaded in an advantageous manor to secure end caps 4 and 5 to bottle 1.

It is envisioned that end caps 4 and 5 and lace 6 will be either sold as a package or given away be beverage bottlers to promote their product so that the recipient of this package may assemble his own ellipsoidal-like ball from an empty plastic beverage bottle at home, on a picnic or at the beach. It is further envisioned that recycled empty plastic beverage bottles could have end caps 4 and 5 and lace 6 assembled thereto to provide an ellipsoidal-like ball as a product for sale. In both of the above uses for the instant invention the amount of trash going to landfills would be reduced.

While I have described above the principles of my invention in connection with specific apparatus, it is to be clearly understood that this description is made only by way of example and not as a limitation to the scope of my invention as set forth in the objects thereof and in the accompanying claims.

I claim:

1. An ellipsoidal-like ball comprising:
a capped, plastic beverage bottle emptied of its beverage;
a pair of identical partial ellipsoid-like plastic end caps each disposed on a different end of said bottle; and
fastening means interconnecting said pair of end caps to secure each of said pair of end caps to said bottle.

2. A ball according to claim 1, further including
ballast disposed within said bottle to provide a desired weight for said ball.

3. A ball according to claim 2, wherein
said fastening means includes
a lace extending between each of said pair of caps to secure said pair of end caps to said bottle.

4. A ball according to claim 3, wherein
said lace is composed of a selected one of a plastic material and an elastic material.

5. A ball according to claim 4, wherein
each of said pair of end caps include
a partial, ellipsoid-like shell having a longitudinal axis along the major axis there of;
a plurality of rib-like members formed on the interior surface of said shell equally spaced about said longitudinal axis oriented to receive the neck of said bottle when engaged therewith;
a first ridge-like abutment formed on each of said plurality of rib-like members in a transverse relation to said longitudinal axis adjacent the apex of said shell to abut the cap of said bottle; and
a second ridge-like abutment formed on each of said plurality of rib-like members in a transverse relation to said longitudinal axis remote from the apex of said shell to abut the bottom of said bottle when engaged therewith.

6. A ball according to claim 5, wherein
said fastening means further includes
a plurality of tabs spaced about the periphery of said shell adjacent said plurality of second ridge-like abutments substantially parallel to said longitudinal axis, and
an eyelet disposed in each of said plurality of tabs through which said lace is threaded.

7. A ball according to claim 5, wherein
said fastening means further includes
a flange extending outwardly from the periphery of said shell adjacent said plurality of second ridge-like abutments in a transverse relation to said longitudinal axis, and
a plurality of spaced eyelets disposed in said flange through which said lace is threaded.

8. A ball according to claim 1, wherein
said fastening means includes
a lace extending between each of said pair of end caps to secure said pair of end caps to said bottle.

9. A ball according to claim 8, wherein
said lace is composed of a selected one of a plastic material and an elastic material.

10. A ball according to claim 9, wherein
each of said pair of end caps includes
a partial, ellipsoid-like shell having a longitudinal axis along the major axis thereof;
a plurality of rib-like members formed on the interior surface of said shell equally spaced about said longitudinal axis oriented to receive the neck of said bottle when engaged therewith;
a first ridge-like abutment formed on each of said plurality of rib-like members in a transverse relation to said longitudinal axis adjacent the apex of said shell to abut the cap of said bottle; and
a second ridge-like abutment formed on each of said plurality of rib-like members in a transverse relation to said longitudinal axis remote from the apex of said shell to abut the bottom of said bottle when engaged therewith.

11. A ball according to claim 10, wherein
said fastening means further includes
a plurality of tabs spaced about the periphery of said shell adjacent said plurality of second ridge-like abutments substantially parallel to said longitudinal axis, and
an eyelet disposed in each of said plurality of tabs through which said lace is threaded.

12. A ball according to claim 10, wherein
said fastening means further includes
a flange extending outwardly from the periphery of said shell adjacent said plurality of second ridge-like abutments in a transverse relation to said longitudinal axis, and
a plurality of space eyelets disposed in said flange through which said lace threaded.

13. A ball according to claim 1, wherein
each of said pair of end caps includes
a partial, ellipsoid-like shell having a longitudinal axis along the major axis thereof
a plurality of rib-like members formed on the interior surface of said shell equally spaced about said longitudinal axis oriented to receive the neck of said bottle when engaged therewith;
a first ridge-like abutment formed on each of said plurality of rib-like members in a transverse relation to said longitudinal axis adjacent the apex of said shell to abut the cap of said bottle; and
a second ridge-like abutment formed on each of said plurality of rib-like members in a transverse relation to said longitudinal axis remote from the apex of said shell to abut the bottom of said bottle when engaged therewith.

14. A ball according to claim 13, wherein
said fastening means includes
a plurality of tabs spaced about the periphery of said shell adjacent said plurality of second ridge-like abutments substantially parallel to said longitudinal axis, and
an eyelet disposed in each of said plurality of tabs through which a lace is threaded to secure said pair of end caps to said bottle.

15. A ball according to claim 13, wherein
said fastening means includes
a flange extending outwardly from the periphery of said shell adjacent said plurality of second ridge-like abutments in a transverse relation to said longitudinal axis, and a plurality of spaced eyelets disposed in said flange through which a lace is threaded to secure said pair of end caps to said bottle.

16. A pair of identical end caps each engaging a different end of a capped plastic beverage bottle emptied of its beverage to form an ellipsoidal-like ball, each of said pair of end caps comprising:

a partial, ellipsoid-like shell having a longitudinal axis along the major axis thereof;

a plurality of rib-like members formed on the interior surface of said shell equally spaced about said longitudinal axis oriented to receive the neck of said bottle when engaged therewith;

a first ridge-like abutment formed on each of said plurality of rib-like members in a transverse relation to said longitudinal axis adjacent the apex of said shell to abut the cap of said bottle; and a second ridge-like abutment formed on each of said plurality of rib-like members in a transverse relation to said longitudinal axis remote from the apex of said shell to abut the bottom of said bottle when engaged therewith.

17. An end cap according to claim 16, further including means formed in said shell adjacent said plurality of second ridge-like abutments to enable fastening said pair of end caps on said bottle.

18. An end cap according to claim 17, wherein said fastening means includes a plurality of tabs spaced about the periphery of said shell substantially parallel to said longitudinal axis, and an eyelet disposed in each of said plurality of tabs through which a lace is threaded to secured said pair of end caps to said bottle.

19. An end cap according to claim 17, wherein said fastening means includes a flange extending outwardly from the periphery of said shell in a transverse relation to said longitudinal axis, and a plurality of spaced eyelets disposed in said flange through which a lace is threaded to secure said pair of end caps to said bottle.

* * * * *